United States Patent [19]

Bartlett

[11] Patent Number: 4,694,499

[45] Date of Patent: Sep. 15, 1987

[54] DIRECTIONAL MICROPHONE WITH ACOUSTIC WASHER

[75] Inventor: Bruce Bartlett, Elkhart, Ind.

[73] Assignee: Crown International, Inc., Elkhart, Ind.

[21] Appl. No.: 701,387

[22] Filed: Feb. 13, 1985

[51] Int. Cl.[4] ..... H04R 1/20; H04R 1/34; H04R 1/38

[52] U.S. Cl. ..... 381/155; 381/158; 381/160; 381/169; 381/188; 381/205

[58] Field of Search ..... 179/121 D, 121 R, 180; 381/155, 158, 160, 168, 169, 205, 188

[56] References Cited

U.S. PATENT DOCUMENTS

| | | | |
|---|---|---|---|
| 3,240,883 | 3/1966 | Seeler | 179/121 D |
| 3,536,863 | 10/1970 | Schenkel | 381/155 |
| 3,585,317 | 6/1971 | Dvorsky | 381/159 |
| 3,617,654 | 11/1971 | Heidrich | 179/115.5 R |
| 3,766,333 | 10/1973 | Watson | 179/115.5 R |
| 3,989,905 | 11/1976 | Anderson et al. | 381/159 |
| 4,034,165 | 7/1977 | Haeder | 179/115.5 R |
| 4,065,648 | 12/1977 | Cvetko et al. | 381/168 |
| 4,363,937 | 12/1982 | Bruna | 381/155 |
| 4,401,859 | 8/1983 | Watson | 179/121 D |
| 4,410,770 | 10/1983 | Hagey | 179/121 D |
| 4,449,236 | 5/1984 | Walker, Jr. | 179/121 D |
| 4,453,045 | 6/1984 | Bruna | 381/169 |
| 4,528,426 | 7/1985 | Fatovic et al. | 381/155 |

FOREIGN PATENT DOCUMENTS

| | | | |
|---|---|---|---|
| 2148466 | 5/1972 | Fed. Rep. of Germany | 179/180 |
| 235918 | 2/1984 | Fed. Rep. of Germany | 179/121 D |
| 53-92119 | 8/1978 | Japan | 179/121 D |
| 915811 | 1/1963 | United Kingdom | 179/121 D |

OTHER PUBLICATIONS

Friedman et al., *Tele-Tech and Electronic Industries,* "A New Cardiod Microphone", Oct. 1955, pp. 70–72+.

*Sound and Communications,* Audio-Technica Ad, Oct. 1984, p. 23.

*Primary Examiner*—Gene Z. Rubinson
*Assistant Examiner*—Danita R. Byrd
*Attorney, Agent, or Firm*—Thomas J. Dodd

[57] ABSTRACT

A directional microphone having an acoustic damping washer positioned about the microphone cartridge adjacent the microphone rear sound entry.

3 Claims, 6 Drawing Figures

DIRECTIONAL MICROPHONE WITH ACOUSTIC WASHER

SUMMARY OF THE INVENTION

This invention relates to an improved directional microphone which utilizes an acoustic sound-absorbing washer.

The microphone of this invention includes a washer formed of sound-absorbing material positioned behind the rear entry of a directional transducer. The washer improves the cancellation of rear approaching sounds, thus improving amplification and rejection of unwanted sounds. Examples of microphones which utilize an acoustic washer are found in U.S. Pat. Nos. 4,410,770; 3,240,883; 3,617,654; 3,766,333; 4,034,165; 4,401,859; and 4,449,236.

Accordingly, it is an object of this invention to provide for a novel directional microphone.

Another object of this invention is to provide for a directional microphone which improves sound reproduction quality.

Another object of this invention is to provide for a directional microphone which effectively cancels reproduction of unwanted sounds.

Other objects of this invention will become apparent upon a reading of the following description.

BRIEF DESCRIPTION OF THE DRAWINGS

A preferred embodiment of the invention has been depicted for purposes of illustration wherein.

DESCRIPTION OF THE PREFERRED EMBODIMENT

The preferred embodiment herein described is not intended to be exhaustive or limited to the precise form disclosed. It is chosen and described to explain the principles of the invention and its application and practical use to enable other skilled in the art to utilize the invention.

Figure 1:
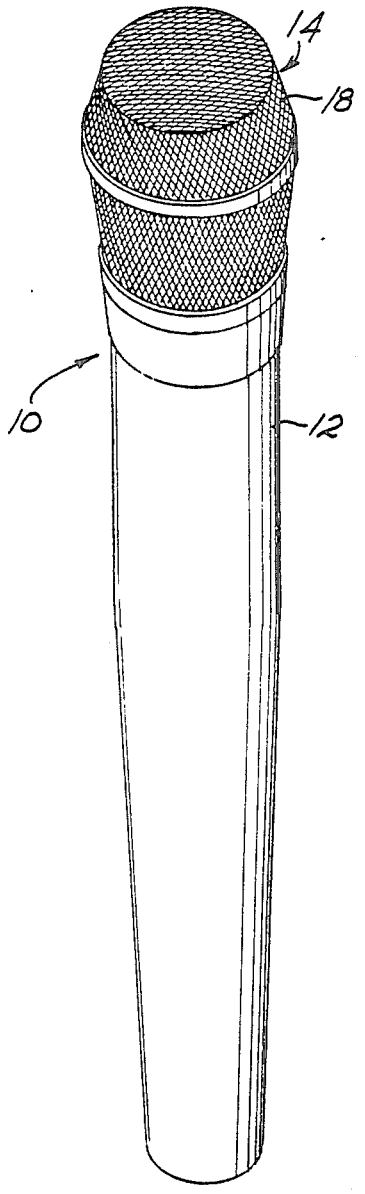
FIG. 1 is a perspective view of the microphone of this invention.
Figure 2:
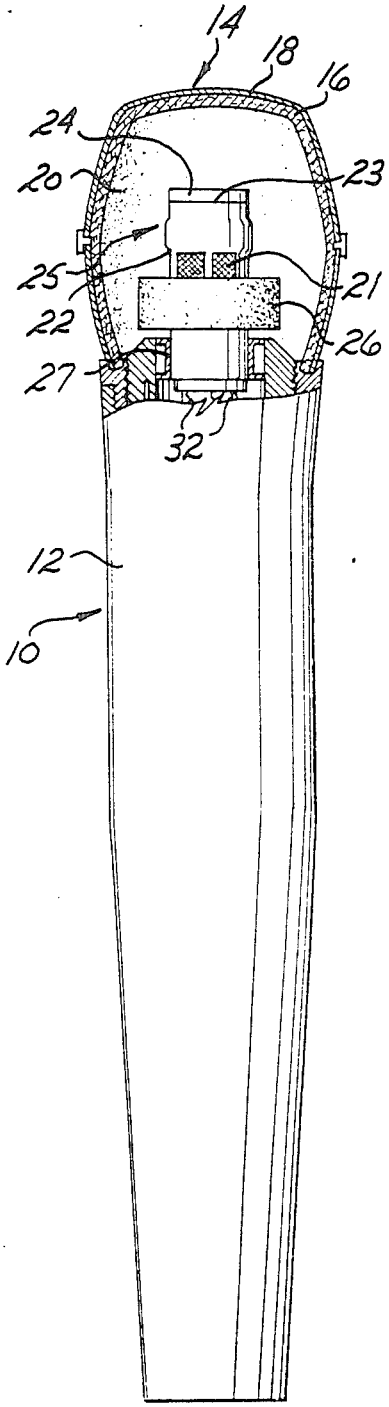
FIG. 2 is an elevational view of the microphone with portions shown in sectionalized form.

The microphone 10 shown in FIGS. 1–2 includes a handle portion 12 adapted for connection to or for the containment of a power source (not shown) and a head 14 connected to the handle. Head 14 includes an inner liner 16 of foam which is covered by a mesh grill 18. An inner sound chamber 20 is defined by head 14. A directional transducer 22, having front sound entry 23 and rear sound entry 21, is positioned within chamber 20 and may include a resonator 24 positioned atop a microphone cartridge 25. Cartridge 25 is carried within head 14 by a shock mount 27, and is connected to a power source (not shown) by leads 32. The construction thus far described is that of a conventional directional microphone.

Figure 3:
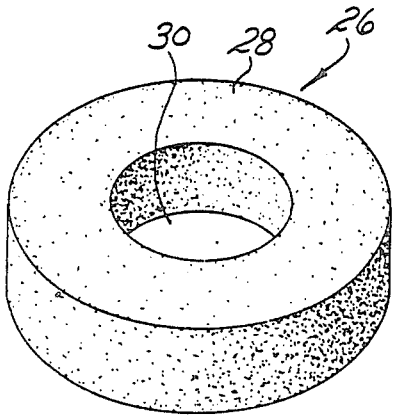
FIG. 3 is a perspective view of the acoustic washer.
Figure 4:
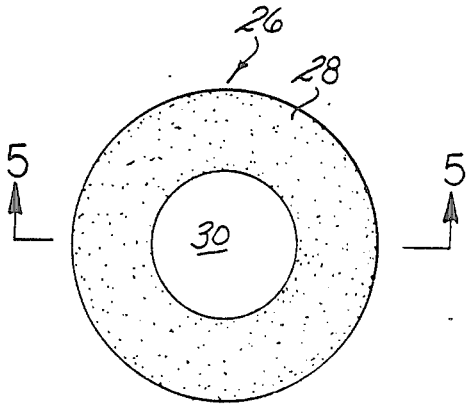
FIG. 4 is a plan view of the washer.
Figure 5:
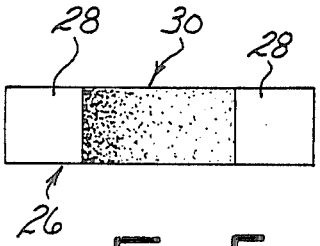
FIG. 5 is a cross-sectional view taken along line 5—5 of FIG. 4.

A washer 26 preferably formed of acoustic damping material such as compressed polyurethane foam is depicted in FIGS. 3–5. Washer 26 includes a generally circular body 28 and a central bore 30 extending completely through the body. Washer 26 is positioned about microphone cartridge 22 at a level adjacently behind rear sound entry 21 as shown in FIG. 2.

Figure 6:
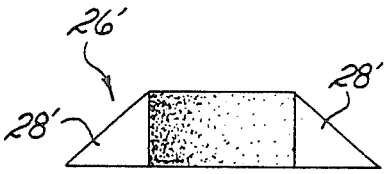
FIG. 6 is a cross-sectional view of a second embodiment of the washer.

Positioned in this fashion, washer 26 reduces reflection of front arriving sounds (improving sound quality) and absorbs and cancels high frequency sounds which approach the rear of transducer 22, improving rear rejection. Alternatively, a washer 26' may have a body 28' of the frusto-conical shape shown in FIG. 6 may be utilized to further reduce reflection of front arriving sounds.

It is to be understood that the invention is not to be limited to the above-given details, but may be modified within the scope of the appended claims.

I claim:

1. In a directional microphone including a head portion defining a sound chamber, a directional microphone cartridge positioned within said sound chamber, said cartridge including a front sound entry and a rear sound entry, the improvement comprising a washer formed of acoustic damping material and having front and rear sides positioned about said cartridge, with said washer front side adjacent said cartridge rear sound entry, said washer constituting means for reducing reflection of sounds approaching the front sound entry and absorbing high frequency sounds approaching said cartridge rear sound entry from said washer rear side.

2. The microphone of claim 1 wherein said washer is formed of compressed polyurethane foam.

3. The microphone of claim 1 wherein said washer is of frusto-conical shape tapering toward said transducer.

* * * * *